US005350430A

United States Patent [19]

Coleman et al.

[11] Patent Number: 5,350,430

[45] Date of Patent: Sep. 27, 1994

[54] OIL/COAL COPROCESSING IN WHICH AGGLOMERATED COAL FORMS PART OF FEEDSTOCK

[75] Inventors: Richard D. Coleman, Orleans; Floyd N. Toll, Russell; Thomas W. McCracken, Orleans; C. Edward Capes, Ottawa; Michio Ikura, Kanata, all of Canada

[73] Assignee: Energy Mines and Resources-Canada, Ottawa, Canada

[21] Appl. No.: 190,984

[22] Filed: Feb. 3, 1994

Related U.S. Application Data

[63] Continuation-in-part of Ser. No. 935,265, Aug. 27, 1992, abandoned.

[51] Int. Cl.[5] ..... C10L 9/00

[52] U.S. Cl. ..... 44/627; 44/621; 209/171

[58] Field of Search ..... 44/620, 621, 627; 209/171

[56] References Cited

U.S. PATENT DOCUMENTS

| | | | |
|---|---|---|---|
| 1,675,266 | 6/1928 | Hansard . | |
| 3,001,856 | 9/1961 | Reerink . | |
| 3,403,989 | 10/1968 | Blake . | |
| 4,153,419 | 5/1979 | Clayfield . | |
| 4,255,155 | 3/1981 | Frankovich | 44/604 |
| 4,282,004 | 8/1981 | Musolgites | 44/626 |
| 4,284,413 | 8/1981 | Capes et al. . | |
| 4,355,999 | 10/1982 | Masologites . | |
| 4,559,060 | 12/1985 | Maroi et al. . | |
| 4,726,810 | 2/1988 | Ignasiak . | |
| 4,776,859 | 10/1988 | Passarini et al. . | |
| 4,859,209 | 8/1989 | Szabó née Mogyorossi et al. . | |
| 4,889,538 | 12/1989 | Mikhlin . | |
| 5,035,721 | 7/1991 | Atherton | 44/626 |
| 5,190,566 | 3/1993 | Sparks et al. | 44/627 |

FOREIGN PATENT DOCUMENTS 1117886 2/1982 Canada .

*Primary Examiner*—Margaret Medley

[57] ABSTRACT

An improved process is described for agglomerating ground coal in which a bridging oil is used as the agglomerating vehicle. This bridging oil is a mixture of a heavy gas oil obtained from coal/oil coprocessing and a heavy hydrocarbon oil, such as bitumen or heavy oil, preferably mixed in the proportion of about 23–40% heavy hydrocarbon oil and 60–77% heavy gas oil. The agglomerated product is mixed with additional heavy oil or bitumen and it becomes the feedstock to a coal/oil coprocessor, with heavy gas oil being formed as one of the product streams. At least part of this heavy gas oil product stream is recycled to the agglomeration stage as the heavy gas oil component of the bridging oil. This agglomeration procedure has the advantage of providing an agglomerate of excellent quality, while carrying out the agglomeration in a short time at ambient temperature and using less than 10% by weight of bridging oil.

5 Claims, 2 Drawing Sheets

OIL/COAL COPROCESSING IN WHICH AGGLOMERATED COAL FORMS PART OF FEEDSTOCK

CROSS-REFERENCE TO RELATED APPLICATION

This application is a continuation-in-part of co-pending U.S. application Ser. No. 07/935,265, filed Aug. 27, 1992 now abandoned.

BACKGROUND OF THE INVENTION

This invention relates to a process for oil agglomeration of ground coal using as bridging agent a mixture of a heavy gas oil obtained from coal/oil coprocessing and a minor proportion of a heavy hydrocarbon oil, such as bitumen or heavy oil, and to coal/oil coprocessing in which the agglomerated coal forms part of the feedstock.

In many industrial applications of coal, e.g. fluidized or pulverized coal combustion, gasification, liquefaction, pyrolysis, coal-liquid mixtures, etc., fine grinding of coal is required. The ground coal mixture contains carbonaceous solids and inorganic solids and it is desirable to be able to separate the carbonaceous solids from the inorganic solids.

Also in coal processing the finely divided carbonaceous solids are produced as by-product and unless a suitable method is available for the use of such materials as fuel or the like, the finely divided carbonaceous solids constitute a waste.

The finely divided carbonaceous solids may be produced in dry form, or they may be in the form of aqueous slurries. For example, in coal processing operations, finely divided coal is produced as a slurry by-product which is normally not completely recovered in coal cleaning operations.

In order to utilize finely ground coal as a feedstock for processes such as coal/oil coprocessing, there has been a need for improved methods of agglomerating the ground carbonaceous solids. It has long been known that mixing oils with aqueous slurries containing finely divided carbonaceous solids and finely divided inorganic solids results in selective agglomeration of carbonaceous solids. Many variations of these processes are known and two examples are those shown in Capes, et al. U.S. Pat. No. 3,365,066 and Puddington et al. U. S. Pat. No. 3,268,071.

It is known that the selective wetting of carbonaceous solids by oil and formation of the agglomerate in an aqueous slurry containing finely divided carbonaceous solids and inorganic solids is based on the difference between surface properties of the carbonaceous solids and inorganic solids. While carbonaceous solids are usually hydrophobic and oleophilic, the inorganic solids are hydrophilic. It has been found that cleaning of low rank coals such as sub-bituminous, lignites and the like as well as oxidized (weathered) higher rank bituminous coals does not result in the production of agglomerates of finely divided carbonaceous solids and oil when mixed with quantities of oil sufficient to agglomerate the carbonaceous solids contained in aqueous slurries. This is mostly due to the lower hydrophobicity as compared to non-oxidized higher rank bituminous coals. Decrease in rank from bituminous to sub-bituminous and further to lignite is usually associated with gradually less hydrophobic balance of the coal surface properties. It is known that low rank or oxidized coal can be agglomerated with oil if a concentrated electrolyte such as concentrated sulphuric acid, concentrated hydrochloric acid or sulphur trioxide gas is mixed with the aqueous slurry.

Ignasiak, U.S. Pat. No. 4,726,810 teaches a method of agglomerating sub-bituminous coal fines using low quality oil such as bitumen, heavy oil and heavy oily emulsions diluted by low viscosity light hydrocarbon oil as diluent. The light hydrocarbon oil is typically kerosene, naphtha or diesel oil and a typical mixture consists of 75% bitumen and 25% light oil. A quite large amount of this bridging liquid is required to achieve agglomeration, e.g. in the order of 10 to 20% by weight on the basis of coal feed.

Another agglomeration procedure utilizing heavy hydrocarbon oils, such as heavy oil or bitumen, is described in Mikhlin et al. U.S. Pat. No. 4,889,538 issued Dec. 26, 1989. That process utilizes heavy hydrocarbon oils, such as vacuum bottoms, as bridging oil at elevated temperature in the acidic phase and with surfactants. The process requires pressurized vessels to prevent the boiling of the aqueous phase. It has significant limitations in requiring (i) use of expensive equipment which will operate at high temperatures and pressures, (ii) use of additional and/or larger equipment at increased cost for the long mixing times necessary to produce agglomerates suitable for screening, (iii) large amounts of acid to lower the pH.

It is the object of the present invention to provide an improved technique for producing coal/oil agglomerates which may be used in coal/oil coprocessing and particularly to provide an inexpensive and effective bridging liquid which can be used for agglomeration at ambient temperatures and pressures.

SUMMARY OF THE INVENTION

According to the present invention it has surprisingly been discovered that an exceptionally effective bridging liquid or agglomerating vehicle for the agglomeration of ground coal is a mixture of a heavy gas oil obtained from a low rank coal/oil coprocessing procedure and a minor proportion of a heavy hydrocarbon oil, such as heavy oil or bitumen. Thus, the novel bridging liquid is mixed with coal fines and water to form agglomerates of the coal fines and this mixing can be carried out at ambient temperatures and pressures and for relatively short times.

The agglomerates produced according to the present invention become feedstock for a coal/oil coprocessing system and the heavy gas oil used to make the agglomerates is obtained from a product stream of the coprocessing procedure. This heavy gas oil typically boils at a temperature in the range of 335° to 525° C.

The heavy hydrocarbon oil used in the present invention is a pitch-like residue containing at least 50% by weight of material which boils above 525° C. This is typically a heavy oil, bitumen, vacuum bottoms, etc. and may be a petroleum oil residue. This is mixed with the heavy gas oil in a ratio of about 23–40% by weight of the heavy hydrocarbon oil and about 60–77% by weight of the heavy gas oil, to form the bridging liquid. Preferably, about 25–40% heavy hydrocarbon oil and about 60–75% heavy gas oil are used, with 25–34% heavy hydrocarbon oil and 66–75% heavy gas oil being most preferred.

It has surprisingly been found that there are special advantages in utilizing as the major portion of the bridging oil the heavy gas oil obtained as a product stream from the coprocessing. Thus, the coprocessing heavy gas oil is rich in heteroatoms which have proved to be more compatible with low rank coals than are light oils. It is commonly known that light oils give good and consistent mineral matter (ash) rejection from bituminous coals whereas heavy oils show erratic behaviour and lower mineral matter rejection. It is believed that this is because of the attachment of polar functional groups (N, S, O) of oil molecules to the mineral matter surface, rendering the mineral matter hydrophobic and resulting in lower mineral matter rejection.

In studies on agglomeration relating to the present invention, it has been found that the polar functional groups appear to alter the hydrophilic surface of low and oxidized coal to hydrophobic (more lipophilic) by a similar mechanism. However, they appear to help retain coal particles in the bridging oil and thus the present invention takes advantage of the coprocessing heavy gas oil characteristic which would normally be considered to be unsuitable for selective agglomeration of coal. Thus, the present inventors have discovered, contrary to common knowledge, that particularly low rank coal is effectively agglomerated by a bridging oil mixture having a high and narrow boiling range and formed from a mixture of coprocessing heavy gas oil and heavy hydrocarbon oil.

It has been found that with the bridging liquid of the present invention, agglomeration does not require any elevated temperature or pressure and it can be carried out at ambient temperatures and pressures. The novel bridging liquid also has the advantage of being capable of agglomerating coal particles at neutral pH and without the need of any surface conditioners.

The bridging liquid of the present invention can also be surprisingly used in very small amounts relative to the coal, and for instance can be used in amounts of less than 10% by weight based on dry coal. Water is typically also present in an amount to form a slurry containing about 10–20 wt % solids and the coal particles typically contain about 5 to 60 wt % ash (mineral matter) on a dry coal basis. The coal is typically ground to a particle size in the order of −28 to +325 mesh (U.S. Sieve), i.e. the particles pass through a 28 mesh screen but not through a 325 mesh screen.

The term "coal" as used herein is intended to designate a normally solid carbonaceous material including all ranks of coal, such as anthracite coal, lignite, peat and mixtures thereof. The invention has been found to be particularly valuable for the treatment of a low rank or oxidized coal.

DESCRIPTION OF THE PREFERRED EMBODIMENTS

In carrying out the present invention, the novel bridging oil (coprocessing heavy gas oil and heavy hydrocarbon oil), ground coal, water and any desired additives are preferably mixed in a high shear mixer where a high rate of agitation occurs. The resulting slurry containing microaggregates of carbonaceous solids with reduced ash or mineral matter content is then passed from the high shear mixer to a low shear mixer having a lower rate of agitation. The agglomeration is continued in the low shear mixer and the resulting slurry is transferred to a separator where the agglomerated particles consisting of coal and bridging oil are separated from the tailings containing the aqueous medium and inorganic solids. The separation may be done by screening, flotation, etc.

The coal/novel bridging oil agglomerates obtained are then mixed with further heavy hydrocarbon oil feedstock to form a coal/heavy hydrocarbon oil slurry feedstock for a coprocessing unit.

The coprocessing is usually carried out in the presence of a hydrogenation catalyst. Such catalysts are well known to those skilled in the art and are usually compounds of metals in the form of oxides or sulfides. They may, for example, comprise compounds of cobalt, molybdenum, iron, tin, nickel, and mixture thereof. According to a particularly preferred feature of this invention, the hydrogenation catalyst may be included as a component of the agglomerated particles. For instance, the catalyst in water-soluble form may be included as part of the additives to the high shear mixer. The catalyst incorporated within the agglomerated particles is particularly advantageous during coprocessing because it means that the catalyst is finely dispersed throughout the agglomerates and is therefore in close proximity to the coal particles.

The coprocessing can be conducted in a system such as that described in Canadian Patent No. 1,117,886 and is typically carried out by passing the slurry feedstock through a confined hydrocracking zone maintained at a temperature above 400° C., a pressure of at least 1.4 MPa and a space velocity between about 0.5 and 4 volumes of hydrocarbon oil per hour per volume of reaction zone capacity. The reaction may be conveniently carried out as an up-flow in an empty tubular reactor with a mixed effluent being collected at the top containing a gaseous phase comprising hydrogen and vaporous hydrocarbons and a liquid phase comprising heavy hydrocarbons. This mixed effluent may be separated into a gaseous stream which can be fed to a low temperature-high pressure separator where it is separated into a gaseous stream containing hydrogen and lesser amount of gaseous hydrocarbons and a liquid product stream which may include naphtha, light gas oil, heavy gas oil, etc. By-products such as sulphur and ammonia may also be obtained. It is also possible to have the coprocessing reactors in stages where the first reactor is an empty tubular reactor and the second reactor contains an ebullated bed of catalyst extrudates.

The heavy gas oil that is obtained as a product stream can be used as a source of the heavy gas oil forming part of the bridging oil for the agglomeration stage. Thus, the required amounts of heavy gas oil for this purpose can simply be split off from the coprocessing heavy gas oil product stream and recycled back to the agglomeration stage.

The coprocessing also produces a residue which includes unreacted coal and mineral solids. In addition to the solids, the residue may also contain a certain amount of light liquid hydrocarbons to assist in the transportation of solids. Since decreased solids in the residue results in a lower light liquid hydrocarbon requirement, the reduction of mineral matter in the coal feed by the oil agglomeration beneficiation increases the net liquid product yields from coprocessing and therefore the overall process efficiency.

BRIEF DESCRIPTION OF THE DRAWING

For a better understanding of the invention, reference is made to the accompanying drawings which illustrates diagrammatically preferred embodiments of the present invention. In the drawings:

As shown in FIG. 1, bitumen or heavy oil is heated in a preheater 10 and the heated oil is divided into a first stream being mixed with a heavy gas oil feed 21 to a high shear agglomerator 11 and a second stream being fed to a coal/bitumen slurry preparation vessel 12. The ground coal, water and any additives are also added to the high shear agglomerator 11. Some agglomeration occurs in vessel 11 and the mixture from the vessel 11 is transferred into a low shear agglomerator 13 which operates at a lower rate of agitation. The agglomeration continues in vessel 13 with the build-up of larger agglomerated particles. The mixture from vessel 13 is transferred to a separator 14 where the agglomerated particles of coal/bitumen is separated from a tailings comprising the water and mineral matter or ash.

Figure 1:
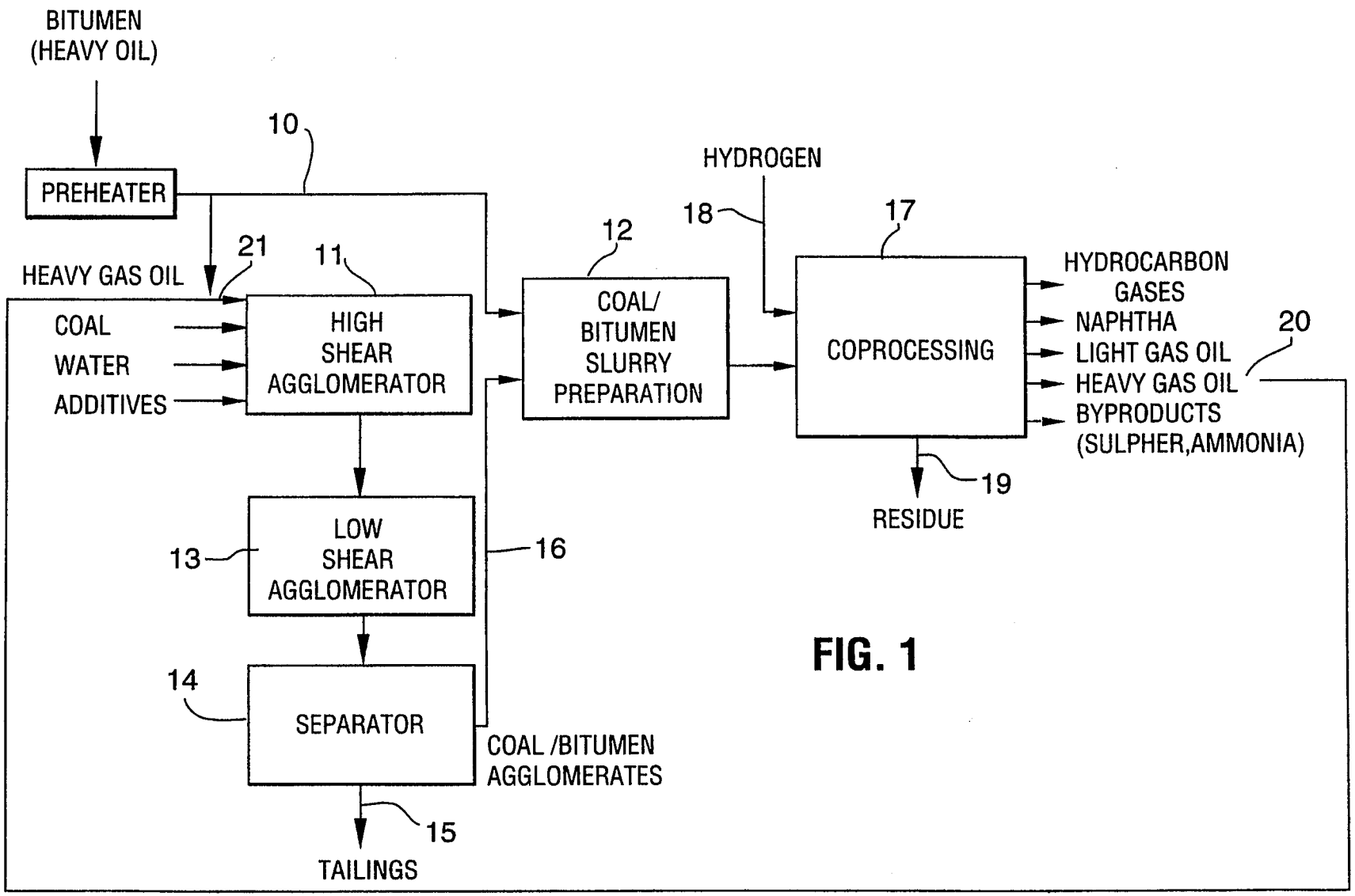
FIG. 1 is a typical flowsheet for a co-processing system according to the invention.

The coal/bitumen agglomerates separated in separator 14 are transferred via line 16 to the coal/bitumen slurry preparation vessel 12. Here the agglomerates are mixed with the additional heated bitumen or heavy oil to provide a feedstock to the coprocessing unit 17. Also added to the coprocessing vessel 17 is hydrogen 18. From the coprocessing there is obtained a heavy pitch residue 19 and a series of distillation products. One of the distillate products is a heavy gas oil stream and part or all of this stream is recycled to the agglomerator via recycle line 21 as the heavy gas oil feed. The following specific examples illustrate the operation of the process of the invention.

EXAMPLE 1

Agglomeration tests were conducted using a sub-bituminous coal from Alberta, Canada known as Battle River coal. The coal had the following characteristics:

| Proximate Analysis (wt %) As received | |
|---|---|
| Moisture | 16.16 |
| Ash | 12.68 |
| Volatile | 32.59 |
| Fixed Carbon | 38.57 |
| Ultimate Analysis (wt %) | |
| Carbon | 51.01 |
| Hydrogen | 3.22 |
| Nitrogen | 1.09 |
| Sulphur | 0.58 |
| Oxygen | 15.26 |

A typical heavy gas oil used for the purposes of the present invention is one boiling between 335° and 525° C. obtained from coprocessing of 30 wt % Battle River sub-bituminous coal and 70 wt % Cold Lake vacuum bottoms. These Cold Lake vacuum bottoms are very heavy hydrocarbons having the following properties:

| | | |
|---|---|---|
| Pitch (+525° C.): | 74.3 | (wt %) |
| Density (kg/L): | 1.042 | |
| Softening point (°C.) | 47 | |
| Solvent Extraction | | |
| Pentane insolubles: | 28.2 | |
| Toluene insolubles: | 1.7 | |
| Elemental analysis (wt %) | | |
| Carbon | 82.8 | |
| Hydrogen | 9.7 | |
| Oxygen | 1.3 | (by difference) |

-continued

| | |
|---|---|
| Nitrogen | 0.6 |
| Sulphur | 5.6 |

The heavy gas oil obtained had the following properties:

| Boiling point distribution | | | |
|---|---|---|---|
| % boiled-off | Temp. (°C.) | Elemental Analysis (wt %) | |
| IBP | 310 | Carbon | 86.3 |
| 10 | 355 | Hydrogen | 10.3 |
| 20 | 373 | Oxygen | less than 0.5 |
| 30 | 388 | Nitrogen | 0.8 |
| 40 | 404 | Sulphur | 2.6 |
| 50 | 419 | Density(kg/L) | 0.950 |
| 60 | 435 | Aromaticity | 41 |
| 70 | 453 | | |
| 80 | 474 | | |
| 90 | 500 | | |
| FBP | 570 | | |

For the basis of comparison, agglomerations were carried out using an NRC standard #4 oil having the following characteristics:

| Distillables (−525° C.): 72.6 wt % Boiling point distribution of the −525° C. fraction | | Residue (+525° C.): 27.4 wt % | |
|---|---|---|---|
| % boiled-off | Temp. (°C.) | Elemental Analysis (wt %) | |
| IBP | 143 | Carbon | 87.0 |
| 10 | 199 | Hydrogen | 11.4 |
| 20 | 225 | Oxygen | less than 0.5 |
| 30 | 249 | Nitrogen | 0.2 |
| 40 | 269 | Sulphur | 1.1 |
| 50 | 285 | Density(kg/L) | 0.922 |
| 60 | 304 | Aromaticity | 37 |
| 70 | 325 | | |
| 80 | 350 | | |
| 90 | 398 | | |
| FBP | 550 | | |

Agglomeration tests were conducted using as bridging oil:

A. NRC #4 oil

B. Coprocessing heavy gas oil (HGO) or

C. a mixture of 75 wt % coprocessing heavy gas oil (HGO) and 25 wt % Cold Lake vacuum bottoms (VB).

The Battle River sub-bituminous coal was ground to less than 60 mesh (U.S. Sieve) as agglomeration feed and the oil agglomeration tests were conducted by adding approximately 75 g of dry coal to a 1 liter Waring blender and diluting with distilled water to a final volume of about 500 ml for a solids content of about 15 wt %. The slurry was agitated for about 1 minute to thoroughly wet the coal fines after which various amounts and types of the bridging oils were added to the blender and the contents were agitated under high shear mixing conditions for 30 seconds followed by 2 minutes of low shear mixing. Two blender batches of agglomerated material were added to a 1.5 liter Denver D-12 Laboratory Float Cell, giving a solids content of about 10 wt % and the product collected as a froth material. The product was washed once in fresh water and again separated in the flotation cell, thereby simulating the further deashing that occurs in full scale dewatering operations in a screen bowl centrifuge. Centrifuge product and centrate, as well as flotation cell primary and secondary tailings were collected, dried, weighed and analyzed for ash content using a LECO MAC 400 proximate analyzer. Ash balances were conducted on each run to evaluate product for yield and carbon recovery. The results obtained are shown in Table 1 below:

TABLE 1

| Bridging Oil Usage | | Product (oil free basis) | | Carbon |
|---|---|---|---|---|
| Type | wt % (mf) | Ash (%) | Yield (%) | Recovery |
| NRC #4 fuel oil | 5.97 | 8.45 | 91.6 | 97.1 |
| HGO only | 5.97 | 9.15 | 75.1 | 78.7 |
| | 7.53 | 8.79 | 83.4 | 87.0 |
| 75% HGO-25% | 6.10 | 9.00 | 92.3 | 96.8 |
| VB mixture | 7.38 | 9.99 | 90.7 | 94.9 |

EXAMPLE 2

Following the general procedure of Example 1, further agglomeration tests were conducted again using Battle River sub-bituminous coal. For these tests, mixtures of the same heavy gas oil and Cold Lake vacuum bottoms were used over a broad concentration range.

Figure 2:
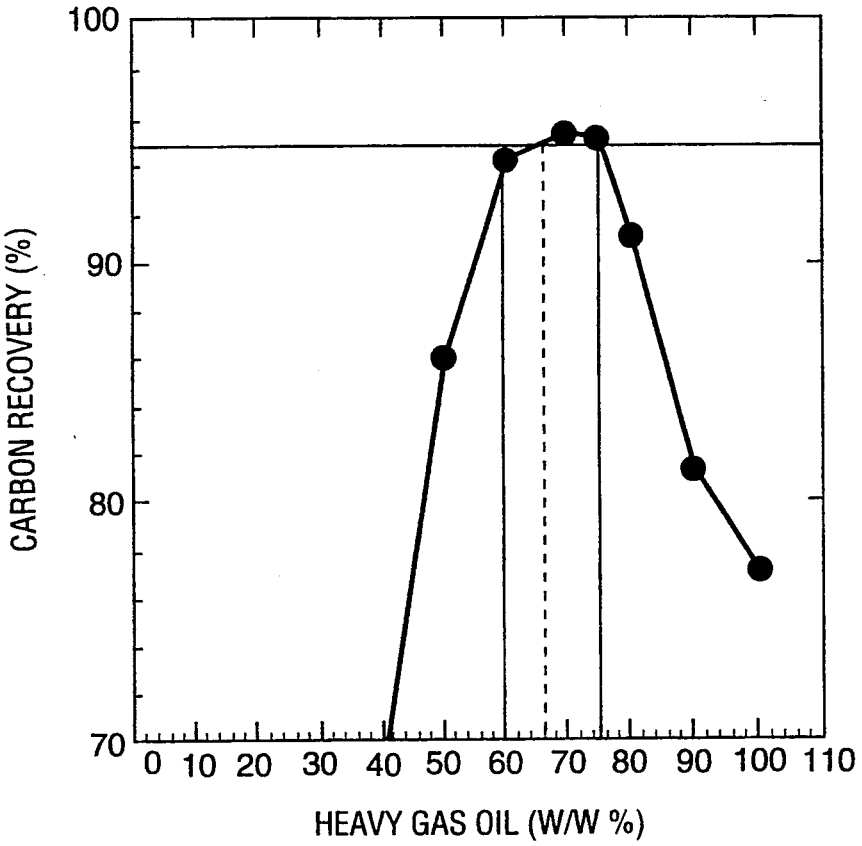
FIG. 2 is a plot of percentage carbon recovery for various mixtures of heavy gas oil and heavy hydrocarbon oil.

The results obtained are shown in FIG. 2, as well as in Table 2 below.

TABLE 2

| Effect of Heavy Gas Oil Ratio | | | |
|---|---|---|---|
| Wt % HGO | Wt % Ash | % Mass Yield | % Carbon Recovery |
| 100 | 14.07 | 74.40 | 76.96 |
| 90 | 14.13 | 78.16 | 81.20 |
| 80 | 14.71 | 87.66 | 91.10 |
| 75 | 13.55 | 90.12 | 95.15 |
| 70 | 13.75 | 90.61 | 95.33 |
| 60 | 13.41 | 88.70 | 94.24 |
| 50 | 11.83 | 79.32 | 85.92 |
| 0 | — | 0 | 0 |

From the results as shown in FIG. 2 and Table 2, the desired high yield comparable to the yields obtained with commercial bridging oil are obtained only with a quite specific mixture of heavy gas oil and heavy hydrocarbon oil. This can be best seen from the plot of FIG. 2, which shows that there is a very dramatic drop in percentage carbon recovery when the percentage of heavy gas oil in the mixture is outside the preferred range.

We claim:

1. In a coal/oil process in which a feed slurry comprising a mixture of (a) a heavy hydrocarbon oil at least 50% by weight of which boils above 525° C. and (b) an agglomerated product comprising coal particles and a bridging liquid, is subjected to hydrocracking and the effluents obtained are separated into separate streams including a heavy gas oil stream, the improvement which comprises forming the agglomerated product by mixing at ambient temperature and pressure an aqueous slurry of low rank coal particles with less than 10% by weight of a bridging liquid which is a mixture of (i) about 60–77% by weight of heavy gas oil obtained from said coal/oil process and boiling in the range of 335°–525° C. and (ii) about 23–40% by weight of said heavy hydrocarbon oil feed, to thereby form agglomerates of said coal particles and separating the agglomerated coal particles from tailings containing mineral matter.

2. A process as claimed in claim 1 wherein the bridging liquid is a mixture containing about 60–75% by weight of said heavy gas oil and about 25–40% by weight of said heavy hydrocarbon oil.

3. A process as claimed in claim 1 wherein the bridging liquid is a mixture containing about 66–75% by weight of said heavy gas oil and about 25–34% by weight of said heavy hydrocarbon oil.

4. A process as claimed in claim 1 wherein the hydrocracking is carried out in the presence of a catalyst.

5. A process as claimed in claim 4 wherein the hydrocracking is carried out in a confined hydrocracking zone maintained at a temperature above 400° C., a pressure of at least 1.4 MPa and a space velocity between about 0.5 and 4 volumes of hydrocarbon oil per hour per volume of reaction zone capacity.

* * * * *